US006024683A

United States Patent [19]

Wilkes

[11] Patent Number: 6,024,683

[45] **Date of Patent: *Feb. 15, 2000**

[54] APPARATUS AND METHOD FOR FABRICATING CONTAINERS

[76] Inventor: Kenneth R. Wilkes, 55 Brookwood Rd., Asheville, N.C. 28804

[ * ] Notice: This patent is subject to a terminal disclaimer.

[21] Appl. No.: 09/036,728

[22] Filed: Mar. 9, 1998

[51] Int. Cl.[7] ..... B65L 25/32; B31B 5/60

[52] U.S. Cl. ..... 493/196; 493/29; 493/210

[58] Field of Search ..... 493/22, 29, 194–196, 493/210, 224

[56] References Cited

U.S. PATENT DOCUMENTS 4,070,951 1/1978 Bala ..... 493/29 X
4,617,850 10/1986 Bishop ..... 493/22 X
4,834,698 5/1989 Osborn ..... 493/29 X
5,201,697 4/1993 Capy ..... 493/22

*Primary Examiner*—Timothy V. Eley
*Assistant Examiner*—Anthony Ojini
*Attorney, Agent, or Firm*—Saul Epstein

[57] ABSTRACT

A pouch making machine which simultaneously creates perimeter seams for a plurality of pouches on a web and temporarily stores the seamed web in an accumulator at the conclusion of the seaming step, and then withdraws the web from the accumulator to sever the individual pouches from the web. The individual pouches are severed from the web by a cutoff knife that is moving at the same velocity as the web during the cut. The withdrawal of the web from the accumulator is carried on independent of the seaming step, except that regulating means is included to make the long term average web speed the same through the seaming step as through the cutoff step.

7 Claims, 7 Drawing Sheets

APPARATUS AND METHOD FOR FABRICATING CONTAINERS

BACKGROUND OF THE INVENTION

This invention relates to the fabrication of containers, for example, flexible sterilizable pouches intended for storing medical or surgical items. The invention is described in the context of such pouches, but the principles disclosed can be applied in other applications, as will be evident to those skilled in the art.

One form of pouch commonly used for storing sterile items, and for other uses, consists of two similarly sized rectangular sheets seamed to each other around their peripheries, using heat and pressure. If intended for gas sterilization (e.g. ethylene oxide or steam) one of the sheets is a made from a porous material which is permeable to the sterilizing gas, but is impermeable to bacteria and the like. This membrane could be, for example, surgical paper or a spun olefin (such as is sold by the DuPont Company under the trade name of Tyvek). The second sheet is usually a transparent non-porous plastic sheet, such as polyethylene, which is impervious to both gas and bacteria. In pouches intended for radiation sterilization, neither of the sheets need be porous; both can be polyethylene, or other suitable material.

A myriad of pouch constructions have been devised over the years, of which a great many are presently in commercial use. A number of examples of pouch designs can be found illustrated in U.S. Pat. Nos. 3,754,700, 4,367,816, 5,549,388, and 5,551,781, and in many other patents.

Whatever the style, pouches are usually made on a machine wherein the various required constituents of the pouch are supplied as webs from large rolls of the respective materials. As the materials are fed through the pouch making machine, the various webs which are used to create the pouch are brought into face to face contact, and the required peripheral and other seams are made. The seams are commonly made by pressing the areas to be seamed between a heated seaming iron (which has the form of the desired seam pattern) and a platen. Since it takes some time (generally between 0.5 and 1 second) to create a seam in this manner, the web feed is made intermittent. That is, the web feed is stopped during the time the seaming iron is pressing the web layers against the platen, and after each seaming is completed the web is then moved to bring the next area to be seamed under the seaming iron.

Other operations which may be needed to be performed on the materials making up the pouch, such as cutting openings in one or more webs, printing, etc., are synchronized with the seaming cycle. These operations may be accomplished while the seams are being formed, or while the web is being drawn between seamings, or in a combination of both.

As noted above, pouch seams are most commonly made by the application of heat and pressure to the seam areas, and the present invention is described herein as though that method is being used. Under some circumstances, however, it may be convenient to make some or all of the seams using adhesives rather than heat to cause the various films to adhere, and it will be appreciated that the principles of the present invention, as described below can be used to fabricate pouches using adhesive technology in place of heat and pressure.

After the needed peripheral and possibly other seams are made, a fresh web area is moved under the seaming iron, and the previously seamed area is moved to a cutoff knife where the completed pouches are severed from the web. The cutoff knife is not usually located immediately adjacent the seaming iron. For practical space reasons, normally there are one or more patterns of perimeter seams between the seaming iron and the cutoff knife, and one or more additional seaming cycles usually occur between the time a seam is made and the time that the just seamed section arrives at the cutoff knife.

Cutoff knives generally operate much faster than do the seaming irons; for example, even before the present invention, knives operating at a rate of five cuts per second or even somewhat faster were available. The cutoff cycle in prior art pouch making machines is also synchronized with the seaming cycle.

In order to achieve relatively high production, it is common to utilize seaming iron assemblies which can make the seams for many (for example, 10 or more) pouches at a time along the length of the web. Hence, in such a machine, pouches are made in two consecutive timewise steps: 1) seaming a plurality of pouches simultaneously, and 2) sequentially cutting off completed pouches. Assuming a seaming iron ten pouches deep, if it takes one second to make the seams for the ten pouches, it will take about an additional two seconds to cut the pouches off the web (at a rate of five per second), for a total of three seconds to make the ten pouches. This is a theoretical rate of 200 pouches per minute. If the seaming iron were twenty pouches deep, the theoretical production would be 240 pouches per minute. The maximum possible theoretical production, even if the seaming iron were an infinite number of pouches deep, would be 300 pouches per minute, being limited by the cutoff rate of prior art cutoff knives (about 5 cuts per second). In a copending application by the present inventor (U.S. patent application Ser. No. 08/824,817) means are disclosed which permits a production rate up to the capacity of the cutoff knife, even though the seaming iron is not of infinite length.

The present invention improves the rate of production of pouch making machines by 1) providing a cutoff knife which can operate at a much faster rate than prior art knives, 2) not stopping the web while severing the pouches (i.e., causing the cutoff knife to travel with the web during the severing operation), and 3) permitting the cutting off of the completed pouches to proceed even while the web is stationary in the seam forming portion of the machine (while the seams are being created).

It is an object of the present invention to provide a pouch fabricating machine and method which improves on the production rate obtainable with prior art pouch fabricating machines.

It is another object of the present invention to provide a web cutting knife capable of much higher cutoff rates when compared to prior art knives.

SUMMARY OF THE INVENTION

In the pouch making method of the present invention, the seaming and cutoff operations are not done sequentially, as in the prior art, but are rather carried out simultaneously and continuously. Pouch production is therefore not a function of the sum of the amount of time it takes to create the seams and the time to sever the pouches from the web, as in the prior art, but rather, is determined by the time to achieve only one of these functions. Hence the production rate is inherently higher than in comparable prior art pouch fabricating machines. Additionally, the cutoff knife used in the present invention is capable of much higher speed operation as compared to knives of the prior art.

In accordance with the present invention, the input webs are fed to a seaming iron, and the peripheral and other seams are made as in the prior art. But when the seams are finished, the web is not fed directly to a cutoff knife, as was done in prior art machines, but is rather fed to an accumulator which accepts the intermittently moving web, and temporarily stores it. The material entering the accumulator from the seaming operation is fed out of the accumulator, as required, to the pouch severing portion of the machine, where the pouches are severed from the web. The pouch severing portion of the machine draws material from the accumulator continuously (albeit, usually not at a constant rate) and severs the pouches without stopping the web. This is done through the use of a knife which moves in the direction of web travel (i.e., the machine direction) as it is cutting the web. It will be appreciated that avoiding the necessity of stopping the web to cut is of great advantage in terms of web handling, and permits greater production than has been heretofore possible.

The timing of the seaming operation and the severing operation are grossly different, but because an accumulator is provided as a buffer between the two operations, both can function simultaneously. The seaming cycle requires the web to be stationary for approximately one second per cycle, whereas the cutoff cycle does not require the web to be stopped at all. While the long term average web speed past the seaming iron and the cutoff knife are the same, the instantaneous speeds are vastly different, the accumulator absorbing the short term differences in web travel.

The production rate of machines made according to the principles disclosed herein is limited only by the web handling capabilities of the machine or by the maximum cut rate of the knife. Knives made according to the present invention can easily make 800–1000 or even more cuts per minute. Modern web handling techniques, including the use of servo motors and carefully programmed acceleration/decelleration profiles, make such production practical.

The invention is described in greater detail in the below detailed description and in the accompanying drawings, from which a more comprehensive understanding of the invention may be had.

DETAILED DESCRIPTION OF THE INVENTION

Words in this document are generally used in accordance with their ordinary meanings, else their meanings are evident from the context or are defined. For convenience and in order to aid understanding, the phrase "machine direction" is used to refer to the direction of motion of the web as it passes through the fabrication process, "seaming iron depth" is intended to refer to the number of pouches in the machine direction seamed on each activation of the seaming iron, and "mesh" is used to indicate a scissors type cutting motion between two adjacent blades. Other definitions appear in the text as the occasion arises. Finally, while the following description is couched in terms of a "pouch", it should be understood that the terms "pouch", "container", "package" or similar term used in this document are meant to encompass any or all of the others, the particular word used in a particular case being a matter of linguistic style.

Figure 1:
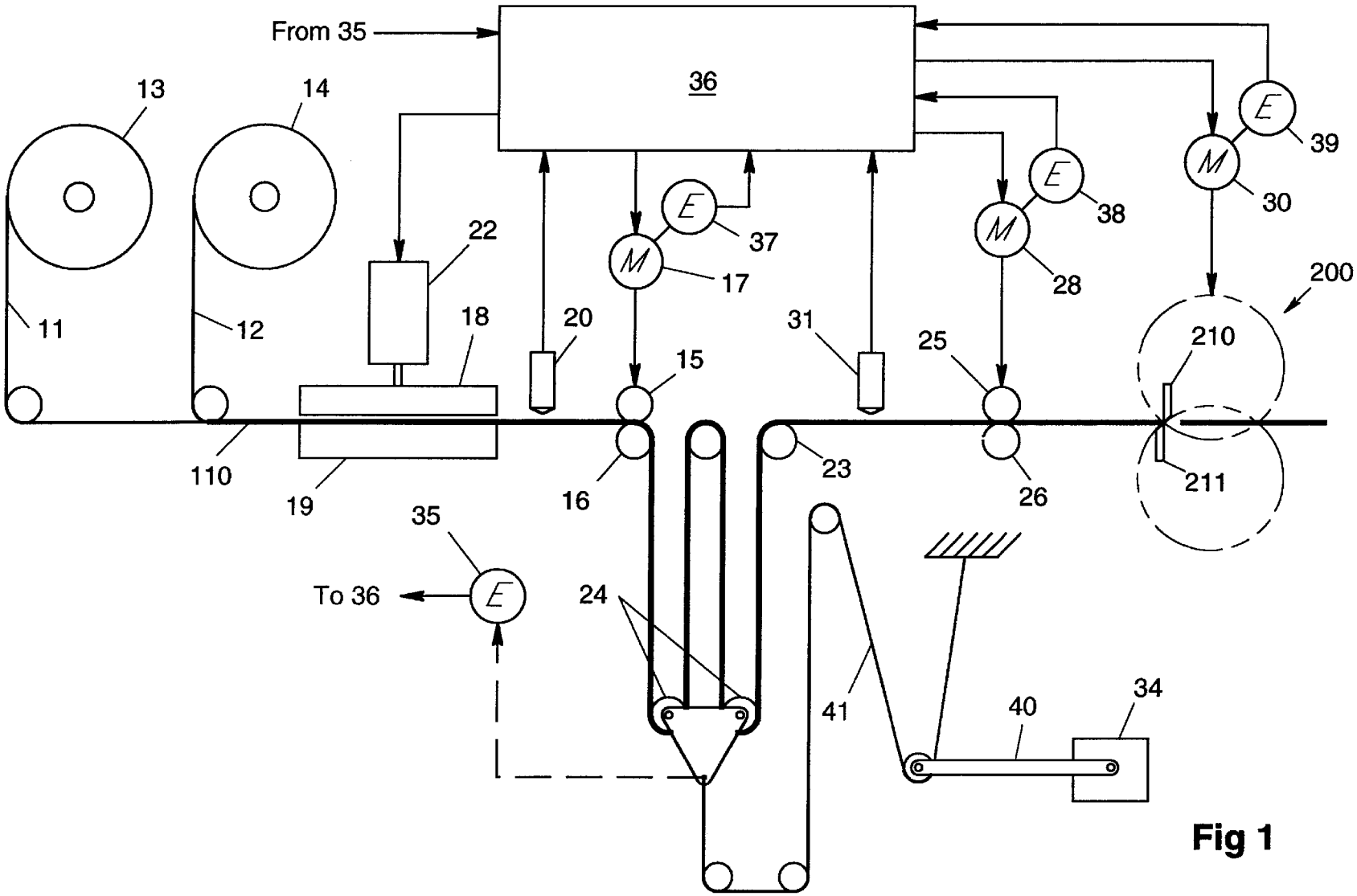
FIG. 1 is a schematic side view of a pouch making machine embodying the present invention.

FIG. 1 is a schematic side view of a pouch making machine embodying the present invention. The construction of pouch making machines in general is well known, so that constructional details are unnecessary to convey a knowledge of the invention to those skilled in the art. For illustrative purposes, a machine is shown which produces a conventional "chevron" pouch. Such a pouch consists of two rectangular sheets seamed together around three of their four sides, the fourth side seam being made after the pouch is completed and the desired contents inserted. The seam on the side of the pouch opposite the omitted seam is in the shape of a chevron, hence the name.

While a machine embodying the principles of the present invention can be made wherein the seaming iron is only one pouch deep, best advantage of the invention will be had if the seaming iron is at least two, and preferably many pouches deep. The depth of the seaming iron actually used is a matter of economics and convenience; any desired number can be used in connection with the present invention within the constraints of space and practicality. Similarly, the seaming iron may be any number of pouches wide, as is economical under the circumstances. The following description will assume that the seaming iron is only one pouch wide, but it will be appreciated that this is an arbitrary choice for convenience in explanation. If the seaming iron were more than one pouch wide, it would be necessary to slit the web apart between the pouches before the final cutoff step, but otherwise the explanation of the process would be identical to that which follows.

As seen in FIG. 1, two webs of sheet stock 11 and 12 are fed into the pouch making machine from rolls 13 and 14. The webs 11 and 12 are drawn (under tension) into the machine by rollers 15/16. Web tensioning devices are well known in the art and hence are not described here. One or both of rollers 15/16 are driven by motor 17. The motion is intermittent in that the webs are drawn rapidly into the machine for a period of time, and then the motion stopped for some other period of time to allow the perimeter seams of the pouches to be made. The seams (112) are preferably created by pressing the webs between hot seaming iron 18 and platen 19. The seaming iron 18 is pressed against platen 19 by one or more hydraulic or air cylinders 22 under the control of computer 36. The temperature of seaming iron 18, and the duration of the pressing cycle are variables which depend on the particular materials used and the characteristics of the seam desired. A common duration for the pressing cycle is about one second. After the perimeter seams are made and seaming iron 18 released, rollers 15/16 draw the composite web 110 along the machine direction until the material for the next set of pouches is in position to have the perimeter seams created. It is preferred that web 12 have indicia printed thereon (shown as marks 113 in FIG. 2) spaced one pouch length apart. Photosensitive sensor 20 is positioned to detect the marks, and computer 36 causes the rollers 15/16 to stop after the number of marks equal to the depth of the seaming have been detected.

As the rollers 15/16 are drawing the webs 11 and 12 under the seaming iron, the web section on which pouch seams have previously been formed is passed into the accumulator portion of the machine. The accumulator is the portion of the machine between rollers 15/16 and roller 23. As the web 110 is fed into the accumulator, a force provided by torque motor 34 (acting through arm 40 and flexible line 41) causes dancer rollers 24 to move downward and accommodate the web being fed in. Dancer rollers 24 preferably have little mass so that, at the high speeds of operation of which the invented machine is capable, inertial effects do not create problems. The motion of dancer rollers 24 is sensed by vertical position encoder 35, and the resulting position data is transmitted to computer 36.

The term accumulator as used herein refers to a section of a pouch making machine which temporarily stores varying amounts of web material so as to permit the instantaneous velocity of the web entering the section to not necessarily be the same as the instantaneous velocity of the web leaving the section. Such instantaneous input/output velocity differences cause the amount of web material stored in the accumulator to vary with time. The control system used to regulate the relative speeds of of the seaming section and the cutoff section of the machine will be discussed below.

Figure 2:
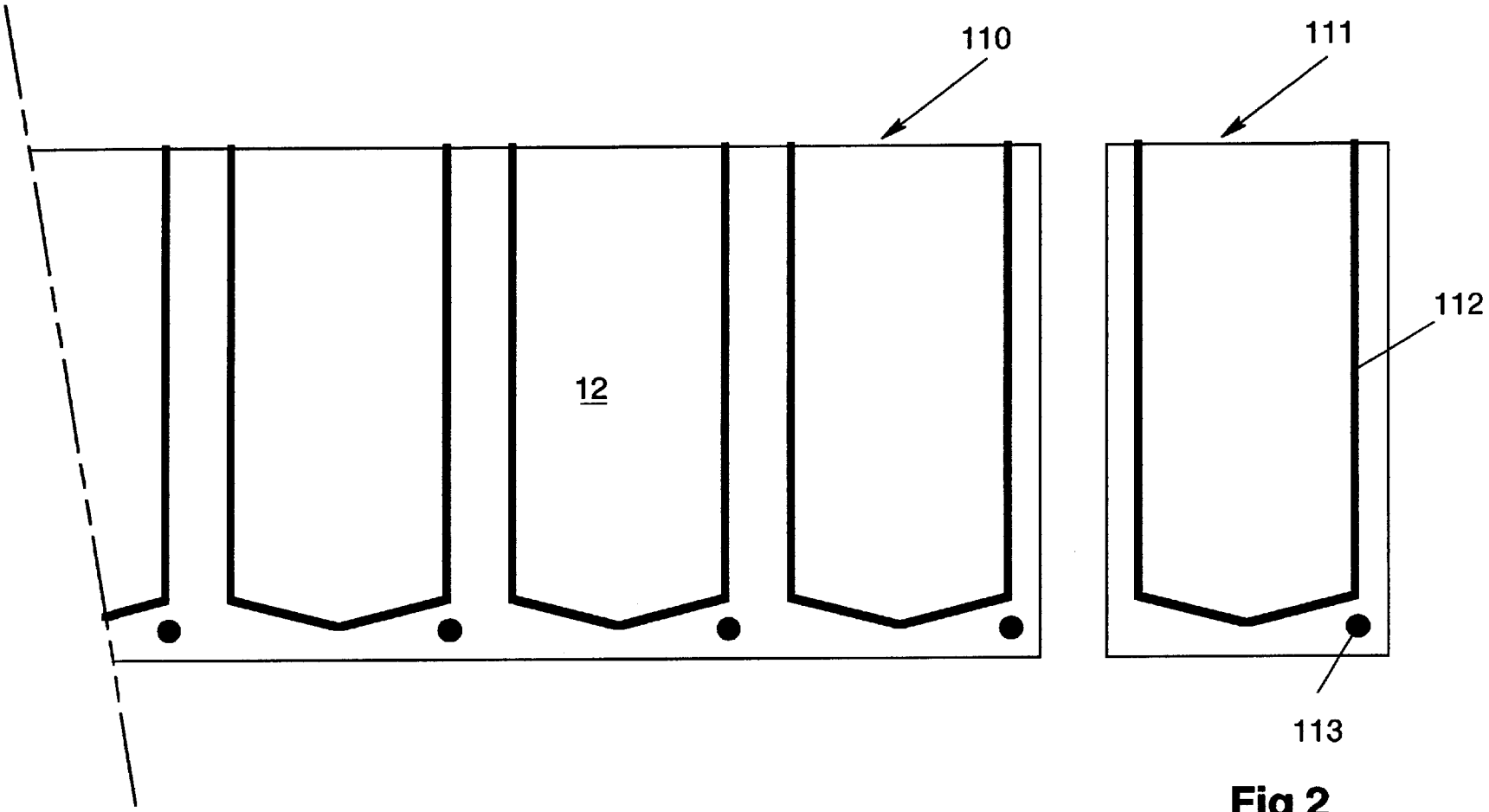
FIG. 2 is a top plan view of a portion of a web in process in the machine of FIG. 1, the portion shown being at 2—2 of FIG. 1. A completed pouch severed from the web is also shown in the figure.

While the web 110 is being fed into the accumulator by rollers 15/16, rollers 25/26 withdraw material from the accumulator and feed it to the cutting mechanism (for example shear 200) where the individual pouches are cut off the web. FIG. 2 illustrates a portion of the web 110 after seaming and just before reaching the shear (and also a completed pouch (111) after it has been severed from the web). Rollers 25/26 are driven by motor 28 under the control of computer 36, advancing the web as required to synchronize with the cutting mechanism. Photosensitive sensor 31 detects marks 113 on the web as rollers 25/26 feed the web out of the accumulator.

One difference between the motion of rollers 15/16 and 25/26 is that rollers 15/16 advance the web many pouch lengths per seaming cycle (as many pouch lengths as the seaming iron is deep), whereas rollers 25/26 advance the web one pouch length per cutoff cycle. Another difference is that rollers 15/16 are stopped for a period of time during each seaming cycle to permit the seams to be created, whereas, rollers 25/26 never stop (even though their instantaneous speed may vary substantially during a cutoff cycle).

While the long term average speed of the web 110 leaving the accumulator is set to be the same as that of the web entering the accumulator, the instantaneous speeds are obviously quite different. The accumulator absorbs the short term variation in input/output material caused by the differences in instantaneous speed.

Figure 3:
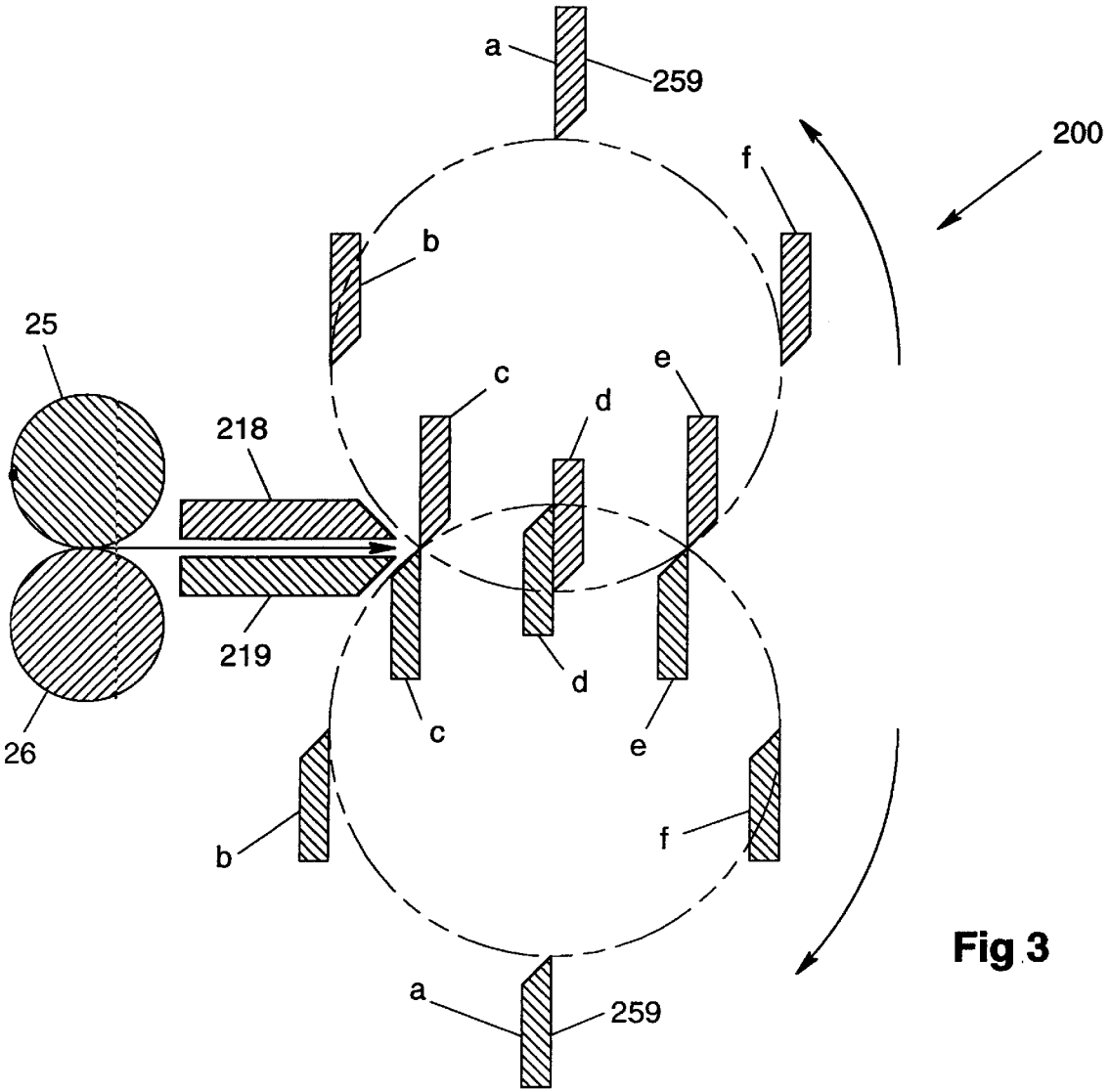
FIG. 3 is a schematic side view of a first embodiment of a cutting mechanism for use in connection with the present invention showing the paths taken by the blades during a cutoff operation.

One embodiment of a novel cutting mechanism which can be used in connection with the present invention is depicted in FIGS. 3–7. FIG. 3 is a schematic depiction of this embodiment, viewed from the side. In general terms, the cutting action is accomplished by shear 200 comprised of a pair of meshing blades 210 and 211. By "meshing" is meant engagement with a scissors like action. Instead of moving reciprocally in an up/down motion as do the blades of prior art scissors type cutters, the cutting edges of the blades in shear 200 move horizontally in the direction of web motion while the cut is being made by the vertical motion. In this embodiment the blades move with a circular motion, which has both vertical and horizontal components. FIG. 3 shows the blades in six positions, "a" through "f", during a cutoff cycle. Note that the blades 210 and 211 are continuously moving in circular orbits (212 and 213), and do not stop at the positions shown. The figure shows the upper blade 210 and the lower blade 211 in each of the illustrative positions. One rotation of the blades represents one cutoff cycle. Position "a" is where the blades are furthest apart, position "d" is where they are completely meshed, positions "c" and "e" are the positions where the blades are just beginning to mesh and their last point of contact, respectively, and positions "b" and "f" are intermediate points shown for reference. The phantom line circles 212 and 213 shown in FIG. 3 represent the loci of the cutting edges of blades 210 and 211 as they travel during a cutoff cycle.

The web 110 is shown being fed into the cutter by nip rollers 25 and 26. Stationary guides 218 and 219 assist in directing the web into the cutter.

The blades 210 and 211 are constrained (by means which will be described below) to maintain constant their angular attitudes in space as well as their horizontal positions relative to each other while their respective cutting edges trace out overlapping circles 212 and 213. As indicated in FIG. 3, blade 210 rotates in a counterclockwise direction, while blade 211 rotates in a clockwise direction. Hence, during the half rotation when the blades are closest (between positions "b" and "f" while passing through positions "c", "d", and "e") the horizontal motion of the blades is in the direction of motion of web 110, (i.e., the machine direction).

The horizontal speed of web 110 is regulated (by computer 36 responsive to encoders 38 and 39, as will be discussed later) to be substantially equal to the horizontal speed of the blades 210 and 211 when the blades are between positions "c" and "d". The blades 210 and 211 are preferably (but not necessarily) rotating at a constant angular speed, which implies that their horizontal speeds between positions "c" and "d" are not constant; hence the speed of web 110 will also vary during the cutting interval. Note that it would appear from FIG. 1 that the web is cut at the instant the blades pass position "c", but FIG. 3 is intended to illustrate the principle involved, and in practical machines, as will be discussed later, the cutting interval is spread out over a significant angle of motion of the blades.

To the extent that there is a mismatch between the horizontal speeds of the web and the cutter blades during the cutting interval, it is preferred that the web be moving faster than the cutter blades. Under this circumstance, a slight buckling of the web may occur during the cutting interval, but so long as the mismatch is not great, satisfactory cuts can be made.

Figure 4:
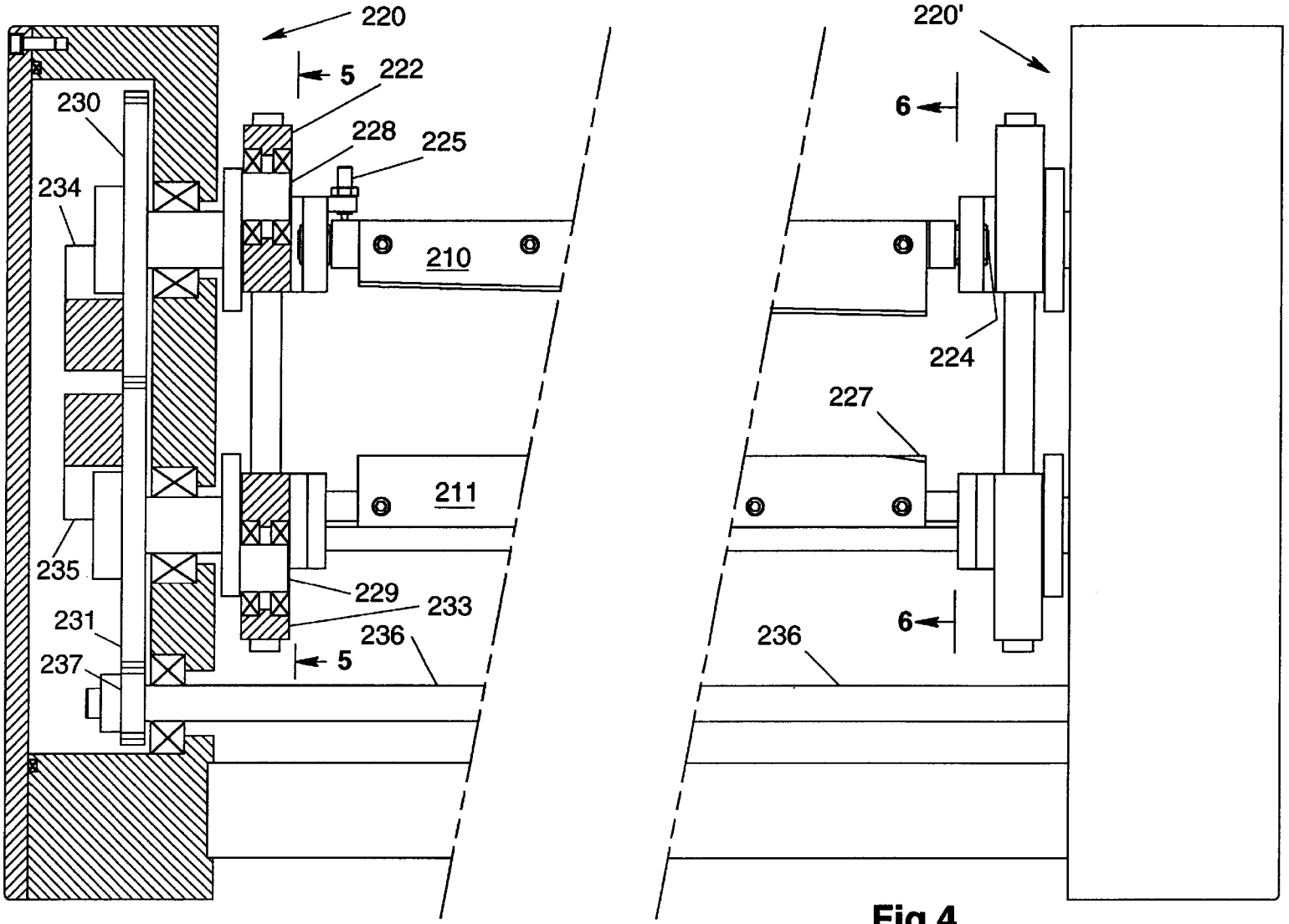
FIG. 4 is an end view of a cutting mechanism utilizing the principles shown in the mechanism of FIG. 3, partially cross sectioned.
Figure 6:
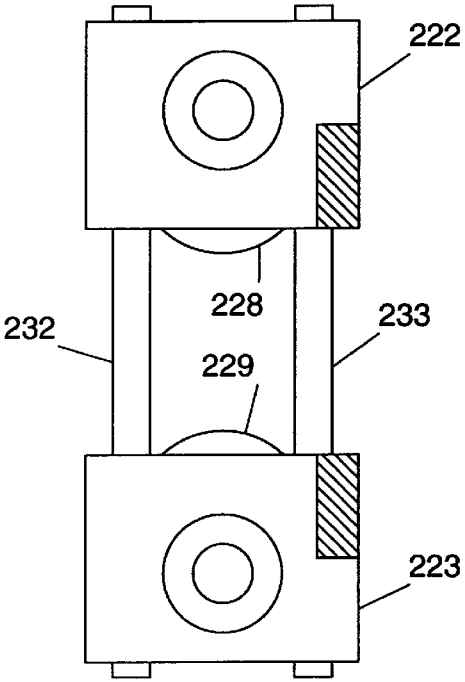
FIG. 6 is a side view of an interior portion of the cutting mechanism shown in FIG. 4, taken at 6—6 of FIG. 4.
Figure 5:
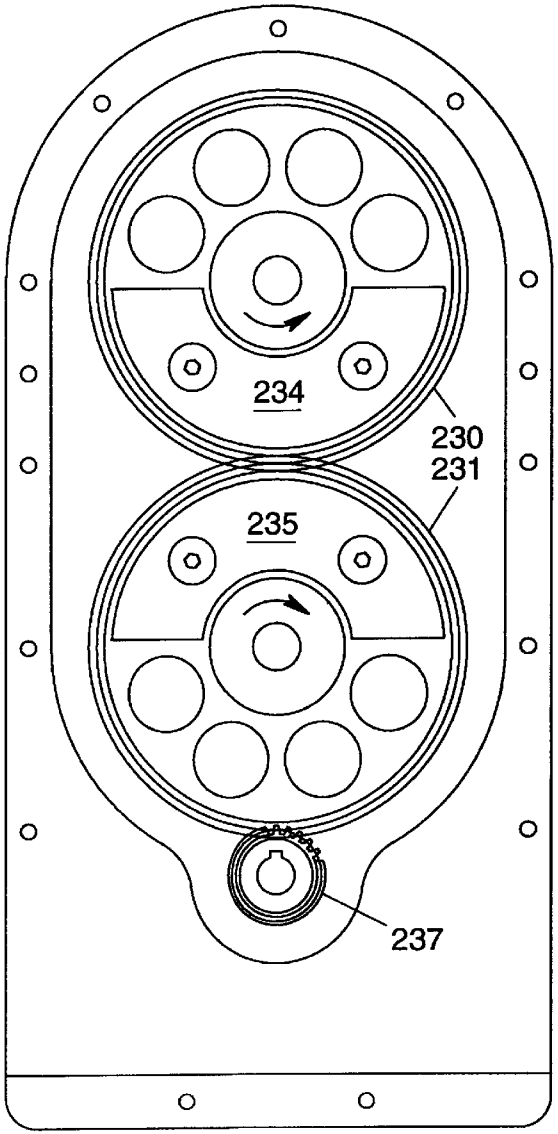
FIG. 5 is a side view of the cutting mechanism of FIG. 4, with the cover removed to show the interior.

Referring next to FIG. 4, a partially cross sectioned end view of the cutting mechanism described above is shown looking back into the cutter from the output side. With the exception of a few details, the cutter has left/right symmetry, and hence much of the following description will describe only the portion which appears at the left in FIG. 4, it being understood that, generally, parts described on the left side of FIG. 4 have counterparts on the right. As seen in FIGS. 4–6, the cutter is shown with blades 210 and 211 in their most distant position, whereas in FIG. 7, the blades are shown completely meshed.

Figure 7:
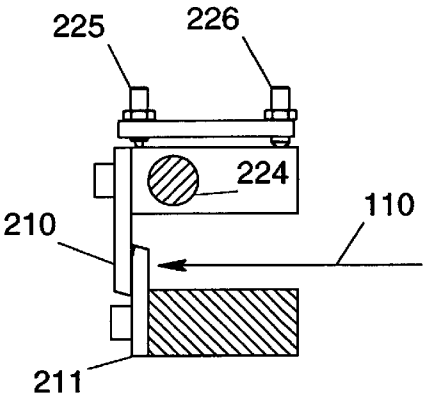
FIG. 7 is a side view of the cutter blades of the embodiment shown in FIG. 4, taken at 7—7 of FIG. 4, but with the mechanism rotated so that the blades are completely meshed.

The upper and lower blades 210 and 211 are shown mounted between left and right guide assemblies 220 and 220', which assemblies assure that blades 210 and 211 maintain their angular and spatial positioning relative to each other. Blade 210 is coupled to upper guide block 222 and blade 211 is coupled to lower guide block 223. Blade 211 is rigidly attached to lower guide block 223, however, blade 210 is allowed to rotate slightly about axle 224 (FIG. 7). Spring loaded button 225 causes blade 210 to press against blade 211 when the blades are meshed, but the rotation is limited by stop 226 so that excessive rotation is not experienced (when the blades are not in contact). Blade 211 has a small lead-in 227 ground on a corner to assure proper meshing of the blades. It may be found that the initial contact between blade 210 and the lead-in 227 causes objectionable noise, particularly at high speeds, and in such cases a linear cam arrangement (not shown) can be used to create a gentler initial contact between the blades. In order to obtain good cutting action, it may be found to be advantageous to mount the blades such that the cutting edges are not precisely parallel, but rather cross slightly along their length.

It will be noticed that, as shown in FIG. 4, the cutting edge of blade 210 slopes downward to the right, whereas the cutting edge of blade 211 is horizontal. This configuration causes the shearing action of the blades to be spread out over some time interval, rather than being concentrated. Spreading of the shearing action is preferred since the cutting force requirements under such conditions are less. Whether the upper blade is sloped or whether the lower blade, or both are sloped to provide the distributed shearing action is a matter of choice.

Guide blocks 222 and 223 are driven in circular paths by cranks 228 and 229, which in turn are driven (in opposite directions) by gears 230 and 231. Guide blocks 222 and 223 are kept in alignment by guide rods 232 and 233, which preferably are a slip fit in guide block 223 and a tight fit in guide block 222. Since blades 210 and 211, together with their supporting structures, represent a substantial unbalanced mass, counterweights 234 and 235 on gears 230 and 231 might be desired. Motive power for the cutter is provided by motor 30 coupled to gears 230 and 231 through axle 236 and gear 237.

Figure 8:
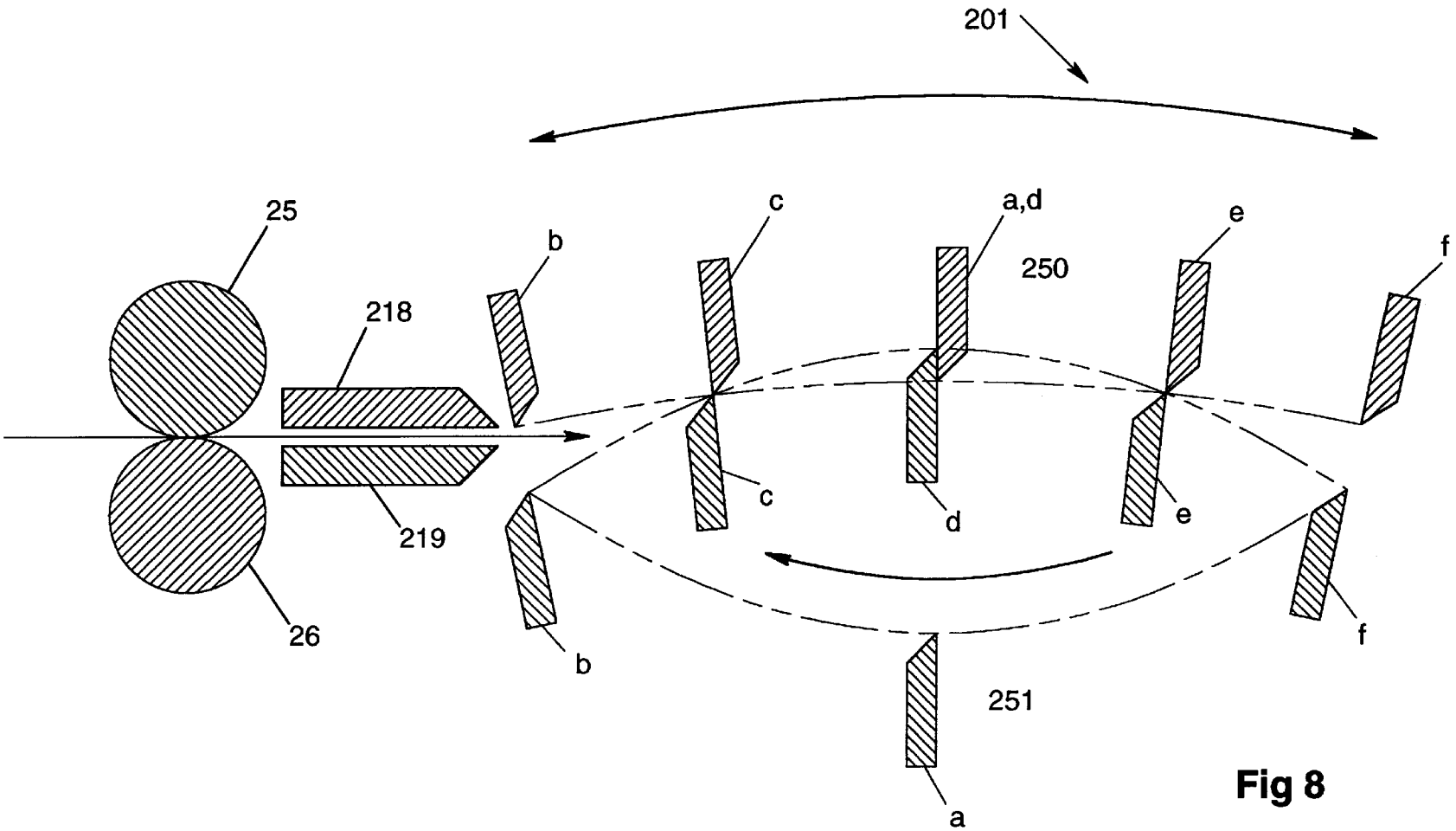
FIG. 8 is a schematic side view of a second embodiment of a cutting mechanism for use in connection with the present invention showing the paths taken by the blades during a cutoff operation.

A second embodiment of a cutting mechanism for use in connection with the present invention is illustrated in FIGS. 8–11. FIG. 8 is a schematic diagram illustrating the operation of the shear 201 (viewed from the side). Web 110 is fed into the shear 201 by nip rolls 25 and 26. Similar to the first shear embodiment, the knife is comprised of two blades 250 and 251 which cut using a scissors action. The blades travel in different paths, however, as compared to the first embodiment. FIG. 8 shows the blades in five positions covering one cutoff cycle, "a" through "f". Blade position "a" is the position where the blades are furthest apart, and blade position "d" is where they are at maximum mesh. By means which will be described later, the angular relationship between the blades is kept constant. Blade 250 is caused to rock back and forth, preferably at a constant radius, by servo motor 30, and the cutting edge thereby traces out an arcuate path represented by the phantom line 248 in FIG. 8. Positions "a" and "d" for blade 250 are in the same place. Blade 251 is also caused to rock back and forth by the servo motor 30, but not with a constant radius. The radius may be caused to vary by servo motor 30, or a separate servo motor 30' (not shown) can be used to provide the required motion. The cutting edge of blade 251 traces out a somewhat elliptical path as it rocks back and forth, as represented by the phantom line 249. The blades start to mesh at "c", and are completely meshed at "d".

Figure 11:
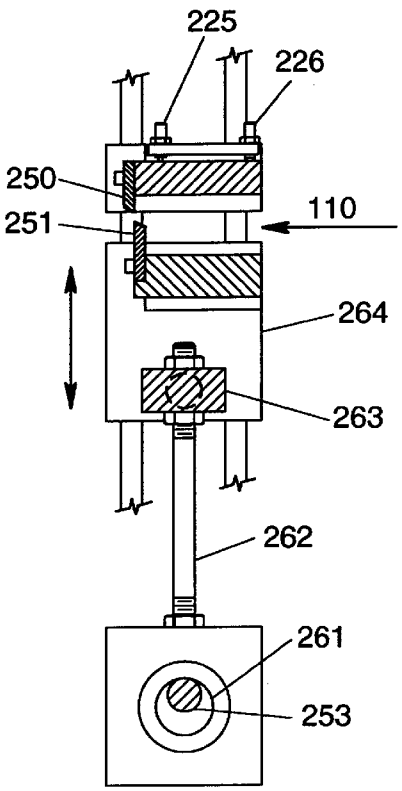
FIG. 11 is a side view of another interior portion of the embodiment shown in FIG. 9, taken at 11—11 of FIG. 9.
Figure 10:
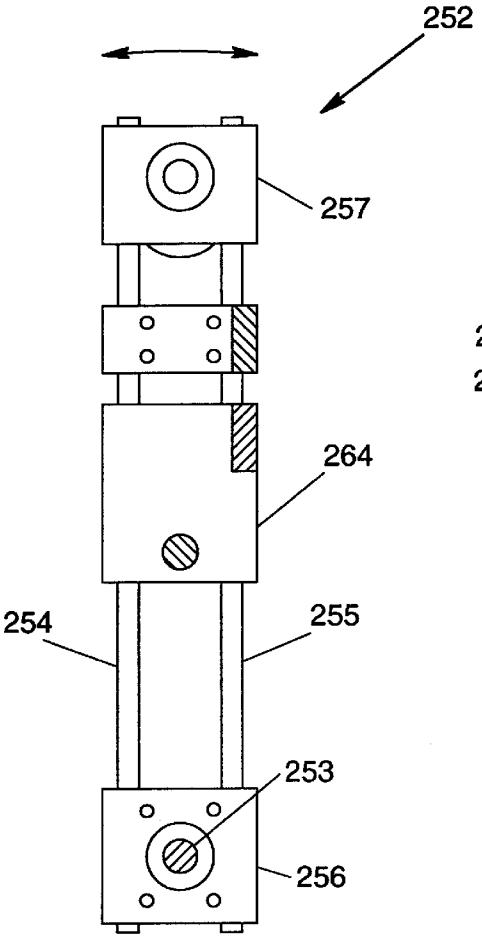
FIG. 10 is a side view of an interior portion of the embodiment shown in FIG. 9, taken at 10—10 of FIG. 9.
Figure 9:
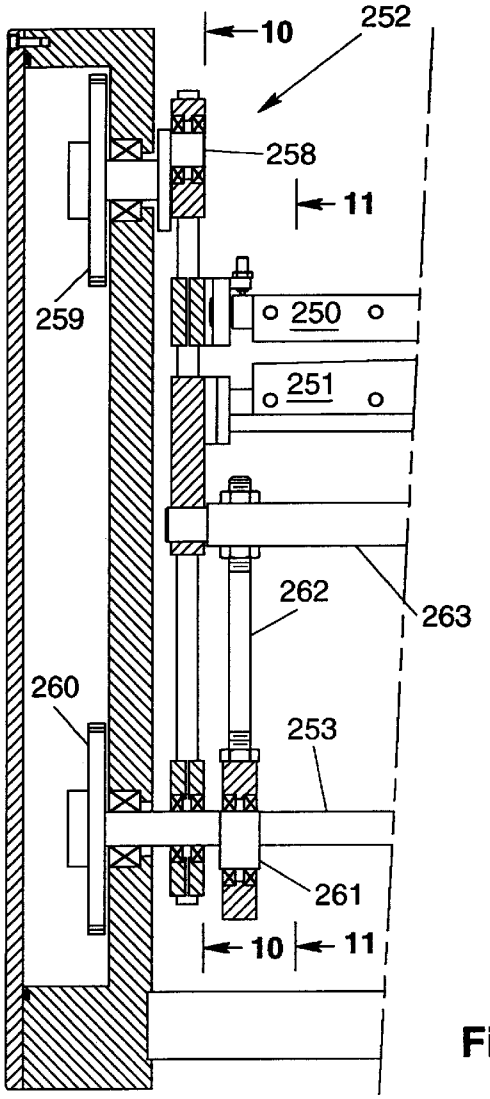
FIG. 9 is an end view of of the cutting mechanism utilizing the principles shown in FIG. 8, partially sectioned, showing only one half of the mechanism.

FIGS. 9 through 11 show the actual construction of the second embodiment of the cutting mechanism illustrated in FIG. 8. While only the left portion of the cutter is shown in FIG. 9, it will be understood that, as in the first embodiment, this embodiment has left/right symmetry and that with the exception of some minor parts, the elements shown in FIG. 9 have counterparts on the right side of the mechanism.

The upper and lower blades 250 and 251 are shown in FIG. 9 supported by guide assembly 252 (which has a right counterpart guide assembly, not shown). The guide assembly 252 is free to rotate around axle 253, with guide rods 254 and 255 being fixed in block 256. Block 257 is driven by crank 258 and slides up and down on guide rods 254 and 255 as crank 258 turns. Crank 258 is coupled to gear 259, which in turn is driven by motor 30. As crank 258 turns, guide assembly 252 rocks back and forth, pivoting around axle 253 (as indicated in FIG. 10). The motion of blades 250 and 251, as the guide assembly moves, is actually arcuate, but is nonetheless, substantially horizontal.

In addition to its substantially horizontal oscillatory motion, blade 251 is moved upward and caused to mesh with blade 250 by the chain of elements including gear 260, axle 253, eccentric 261, push rod 262, bar 263, and sliding block 264. Gear 260 may be mechanically coupled to gear 259 with a 1:1 gear ratio, or gear 260 may be driven by a separate servo motor (30'), not shown. If gears 259 and 260 are mechanically coupled, the motion of blade 251 will be substantially as illustrated by phantom line 249 in FIG. 8. If a separate servo motor 30' is used to drive gear 260, its speed during a cutoff cycle could be varied so as to bring positions "c" and "e" relatively closer together. This could be desirable in order to provide more time to enable the desired length of web to pass through the shear between cuts.

As in the first embodiment, the speed of the web 110 is controlled by servo motor 28 to match the horizontal speed of the blades when they are between positions "c" and "d", and to increase or decrease the web speed at other times so that the desired length of web is cut off at each cutoff cycle. Alternatively, or in addition, the speed of motor 30 may be varied during each cutoff cycle to achieve the desired pouch length.

Two embodiments of the cutting mechanism of this invention have been described above to illustrate the variety of ways in which the principles of the invention may be applied. It should be apparent that other embodiments are possible within the teachings of the invention. For example, as an alternate construction to the embodiment shown in FIGS. 8–11, instead of rocking back and forth about axle 253, the guide assemblies 252 could easily be mounted for horizontal rectilinear motion on rails or ways and driven by a linear servo motor, rack and pinion, or crank and connecting rod to achieve pure horizontal back and forth motion.

The pouch making machine described above and schematically illustrated in FIG. 1 is comprised of three sections, a seaming section, an accumulator, and a cutoff section. In some senses, the sections operate independently, however, their operations must be coordinated in that their average throughputs (in, for example, pouches per minute) must be close enough to the same to keep the amount of web stored in the accumulator at any time within the accumulator's capacity. The speeds of motors 17, 28, and 30, as well as the operation of cylinder 22 must be closely controlled and coordinated in order to obtain satisfactory operation.

A presently preferred way of regulating the speeds of the various motors to achieve proper system operation is to utilize computer control. The computer (36) receives signals from encoders 35, 37, 38, and 39, as well as from photosensitive sensors 20 and 31, and in return, the computer controls cylinder 22, and motors 17, 28, and 30. All of the control modules for controlling the motors, and all of the signal conditioning units required, are encompassed within the term "computer" as used herein.

The preferred operational plan under computer control begins with entering the independent variables into the computer memory. The preferred independent variables are 1) the length of each pouch, 2) the depth of the seaming iron (in number of pouches), 3) the desired seaming dwell time, and 4) the desired draw time to draw material from rolls 13 and 14 between seamings. Instead of the draw time, the intended number of pouches per unit time (i.e., pouches per minute) could be entered.

From these inputs the computer 36 calculates an appropriate velocity and position profile for motor 17 during the draw sequence which will result in the proper number of marks 113 passing under photosensitive sensor 20 during each draw. The motor 17 is programmed to stop the web a predetermined distance after photosensitive sensor 20 detects the last mark 113 of the desired draw sequence, preferably utilizing encoder 37. That is to say, if the seaming iron is 10 pouches deep, for example, the web will be stopped after each 10 marks 113 are detected. When motor 17 stops, cylinder 22 is energized for the predetermined seaming time (input 1), after which motor 17 starts another draw sequence.

If the desired draw time is used as an independent variable (rather than the alternative, the intended number of pouches per minute), computer 36 calculates the number of pouches per minute to be severed from the web by dividing the depth of the seaming iron (input 2) by the sum of the dwell time (input 3) and the draw time (input 4). This quotient is the number of pouches per minute produced by the seaming section, and hence the number of cuts per minute required of the cutoff knife. The rotational speed of motor 30 is set by computer 36 in accordance with the value calculated (or the value entered, if the alternate independent variable is used). Motor 30 preferably has a uniform angular velocity during the rotation of blades 210 and 211 (or 250 and 251), but under some circumstances, in order to accommodate pouches longer or shorter than can be produced using a constant angular velocity, it may be desirable to either speed up or slow down the rotation of motor 30 between positions "d" to "c", as compared to the speed of rotation between positions "c" to "d"

Motor 28 is programmed to have a non-uniform angular velocity in that the web's velocity is matched to the horizontal velocity of the cutoff knife blades between positions "c" and "d", and then the web is either accelerated or decelerated so that exactly one pouch length of web is fed to position "c" between each arrival of the blades at position "c". Note that at position "d", the web has been completely severed, and it is no longer necessary to maintain close correspondence between the web speed and the horizontal blade speed. In order to accommodate small variations in actual pouch lengths and other variabilities, photo sensor 31 senses each mark 113 some short time before the cutoff knife reaches position "c", and computer 36, responsive to the outputs of encoders 38 and 39, causes motor 28 to bring the correct point on the web to position "c" as the blades start to mesh.

Encoder 35 senses the vertical position of dancer bar 24, and causes the entire machine to stop if the capacity of the accumulator is exceeded. In addition, if encoder 35 senses that the cutoff section is running a little slower or faster than the seaming section (by the lower or upper extreme position of dancer bar 24 drifting up or down), computer 36 will alter the velocity profile of either motor 17 or motor 30 slightly to compensate.

An alternate means for causing the two sections of the machine to run at identical average speeds (and so ensure that the capacity of the accumulator is not exceeded) is to continually or repeatedly compare the number of marks 113 detected by photosensitive sensors 20 and 31 (by computer 36), and if the accumulated difference exceeds a predetermined value, to make a speed correction of either the seaming section (motor 17) or the cutoff section (motor 30) to compensate.

What has been described is a machine and method for fabricating pouches at speeds which have heretofore been considered impractical. Persons skilled in the art will no doubt be able to make various modifications and adaptations of the invention but yet be within the inventive teachings disclosed either explicitly or implicitly herein. The limits of the invention sought to be protected are defined by the following claims.

I claim:

1. A machine for fabricating containers which comprises:

seaming means having a pattern for simultaneously creating seams which define more than one container in a machine direction, each of said containers having a predetermined length in the machine direction;

means for drawing a web comprised of at least two thicknesses of material into position to have seams created on said web by said seaming means;

means for feeding said seamed web to an accumulator;

an accumulator;

means for drawing portions of said web out of said accumulator and feeding same to a web cutoff knife;

control means for causing said means for feeding said web to said cutoff knife to feed a length of said web substantially equal to said predetermined length through said web cutoff knife between cuts; and a web cutoff knife, said knife including two meshing blades which move in the machine direction while cutting, said web being in continuous motion while being cut.

2. A machine for fabricating containers as recited in claim 1 and further including means for equalizing the relative machine direction velocities of said web being fed to said cutoff knife and of said blades of said cutoff knife during the interval while said web is being cut by said knife.

3. A machine for fabricating containers as recited in claim 2 and further including means for altering the velocity of said web being fed to said cutoff knife during the interval that said web is not being cut by said knife.

4. A machine for fabricating containers as recited in claim 1 and further including means for maintaining the amount of said web in said accumulator within predetermined limits.

5. A machine for fabricating pouches which comprises:

seaming means having a pattern for simultaneously creating seams which define more than one pouch in a machine direction;

means for repeatedly drawing a web comprised of at least two thicknesses of pouch materials into position to have seams created by said seaming means and for feeding seamed pouch material into an accumulator;

an accumulator;

a pouch cutoff knife;

means for feeding seamed pouch material out of said accumulator and to said pouch cutoff knife;

control means for adjusting the relative operating times of said seaming means and said pouch cutoff knife to maintain the amount of web material in said accumulator within predetermined limits.

6. A method of fabricating pouches which comprises the steps of:

providing a web of pouch material comprised of at least two thicknesses of said pouch material;

creating successive patterns of seams between said thicknesses of pouch material, each of said patterns including seams which define two or more pouches in a machine direction, each of said pouches having a predetermined length in the machine direction;

feeding said web containing said patterns of seams to an accumulator;

withdrawing said web from said accumulator and feeding same to a cutoff knife; and severing said pouches from said web using a cutoff knife comprised of two meshing blades, said blades being moved in the direction said web is being fed to said cutoff knife while each of said pouches is being severed, said web being in continuous motion while being severed.

7. Apparatus for severing a web into predetermined lengths which comprises:

means for feeding a plastic web through a machine for fabricating packages and to a cutoff knife;

a cutoff knife, said knife including two blades which mesh to sever said web, the operating cycle of said cutoff knife being comprised of a first interval when said cutoff knife is not cutting said web, and a second interval when said cutoff knife is cutting said web;

means for causing said blades to move in a machine direction while meshing and severing said web during said second interval interval; and control means for causing said predetermined length of web to be fed through said cutoff knife during said first interval, and for substantially equalizing the relative velocity in the machine direction of said web and said blades during said second interval.

* * * * *